US008287221B1

(12) United States Patent
Van Roekel

(10) Patent No.: US 8,287,221 B1
(45) Date of Patent: Oct. 16, 2012

(54) WALL-LIFTING SYSTEMS

(76) Inventor: Chad A. Van Roekel, Goodyear, AZ (US)

( * ) Notice: Subject to any disclaimer, the term of this patent is extended or adjusted under 35 U.S.C. 154(b) by 548 days.

(21) Appl. No.: 12/544,065

(22) Filed: Aug. 19, 2009

Related U.S. Application Data

(60) Provisional application No. 61/090,198, filed on Aug. 19, 2008.

(51) Int. Cl.
*B66F 3/00* (2006.01)
*E04G 21/16* (2006.01)

(52) U.S. Cl. ..... 414/11; 52/745.11; 52/749.1

(58) Field of Classification Search ..... 182/169, 182/186.3; 248/354.3, 354.5, 357; 254/100; 414/10–12; 52/127.2, 149, 745.12, 749.1, 52/DIG. 6
See application file for complete search history.

(56) References Cited

U.S. PATENT DOCUMENTS 569,119 A * 10/1896 McCormick ..... 182/170
2,046,516 A * 7/1936 Johnson ..... 182/16
2,914,814 A * 12/1959 Christian et al. ..... 52/127.2
2,945,662 A * 7/1960 Jennings ..... 254/100
3,437,296 A * 4/1969 Hinz ..... 248/354.5
5,163,799 A * 11/1992 Lynn ..... 414/11
5,277,405 A * 1/1994 McSwain ..... 254/98
5,322,404 A 6/1994 Keller
5,343,667 A * 9/1994 Peden ..... 52/699
5,634,301 A 6/1997 Koller
6,000,898 A 12/1999 Sharp
6,234,440 B1 * 5/2001 Boney et al. ..... 248/354.1
6,308,467 B1 10/2001 Timilty
6,840,078 B1 * 1/2005 Clover ..... 72/326
7,040,059 B2 * 5/2006 Hodsdon et al. ..... 52/127.2
7,137,655 B2 * 11/2006 Quarberg ..... 292/339
7,959,123 B1 * 6/2011 Kitscha ..... 248/440.1

* cited by examiner

*Primary Examiner* — Gregory Adams
(74) *Attorney, Agent, or Firm* — Stoneman Law Patent Group; Martin L. Stoneman; Kyle Liudahl

(57) ABSTRACT

A system for safe, efficient lifting of partially fabricated walls during light-frame construction. Such walls are built in a horizontal position and are manually rotated into a vertical position using a lifting apparatus mounted to one or more framing members of the wall. The lifting apparatus allows the wall to be positioned and held at an intermediate resting/safety point for protection of user during the lift. A method of use and kit comprising the lifting apparatus are also disclosed.

14 Claims, 10 Drawing Sheets

WALL-LIFTING SYSTEMS

CROSS-REFERENCE TO RELATED APPLICATION

The present application is related to and claims priority from prior provisional application Ser. No. 61/090,198, filed Aug. 19, 2008, entitled "WALL-LIFTING SYSTEMS", the content of which is incorporated herein by this reference and is not admitted to be prior art with respect to the present invention by the mention in this cross-reference section.

BACKGROUND

This invention relates to improved wall lifting systems used during the construction of framed structures. More particularly, this invention relates to providing a system for safe, efficient lifting of partially fabricated walls during light-frame construction.

In typical light-frame construction, walls are partially fabricated in a horizontal position, typically at ground level, and are subsequently raised to a vertical position during assembly of the wall. Framed walls tend to be large and unwieldy requiring a large work crew to manually lift the framing into place. Manually raised framed walls can become too heavy and unstable for the lifting personnel and can collapse back onto workers located under the structure. This problem is often compounded when raising large multi-story wall sections (balloon framing), due to the increased weight and height of the sections. In the United States, the Occupational Safety and Health Administration (OSHA) has documented numerous injuries related to accidents occurring during the lifting of framed walls, including injuries that resulted in death.

As the popularity of light-framed construction increased, framing contractors developed a variety of rudimentary techniques for the manual lifting of such walls; however, these improvised techniques are often of marginal safety benefit and frequently rely heavily on a construction foreman guessing the weight of a wall and estimating the number of workers necessary to perform the lift. Many lifting failures can be attributed to insufficient numbers of lifting personnel resulting in inadequate support during the lift.

Thus, a need exists for a safe, efficient, and secure system to assist in the lifting of framed wall structures, thereby minimizing the costly hazards associated with such work.

OBJECTS AND FEATURES OF THE INVENTION

A primary object and feature of the present invention is to provide a system overcoming the above-mentioned problems and fulfill the above-mentioned needs.

It is a further object and feature of the present invention to provide such a system that permits safe lifting of walls during framing and building processes.

Another object and feature of the present invention is to provide savings to builders and owners of the built structures.

Other objects and features of the present invention are to allow quicker finish times, fewer job-site accidents, and less material damage.

A further object and feature of the present invention is to decrease insurance claims and costs, by lessening the likelihood that workers are injured during building construction.

A further object and feature of the present invention is to increase project bidding reliability, leading to greater client satisfaction with fewer cost and time-overruns.

Yet another object and feature of the present invention is to provide a greater means of efficiency and cost-effectiveness within the building industry.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a wall-lifting system, relating to using at least one intermediate support bar and at least one force-transfer bar to lift at least one framed wall from a substantially horizontal position to a substantially vertical position, such system comprising: at least one force-transfer bar holder adapted to hold such at least one force-transfer bar; at least one support bar holder adapted to hold such at least one support bar; at least one removable engager adapted to removably engage at least one portion of the at least one framed wall; and at least one pivot link structured and arranged to pivotally link such at least one force-transfer bar holder, such at least one support bar holder, and such at least one removable engager; wherein such at least one pivot link is structured and arranged to provide at least one independent rotation of each one of such at least one force-transfer bar holder, such at least one support bar holder, and such at least one removable engager. Moreover, it provides such a wall-lifting system wherein such at least one force-transfer bar holder and such at least one support bar holder each comprise at least one socket structured and arranged to engage at least one standard dimensional wood member.

Additionally, it provides such a wall-lifting system wherein such at least one force-transfer bar holder and such at least one support bar holder each comprise at least one socket structured and arranged to engage at least one standard dimensional wood member having a nominal width of about four inches and a nominal thickness of about two inches. Also, it provides such a wall-lifting system wherein such at least one removable engager comprises at least one set of fixed jaws structured and arranged to engage opposing sides of at least one framing member of the at least one framed wall. In addition, it provides such a wall-lifting system wherein such at least one set of fixed jaws comprises at least one fastening aperture structured and arranged to pass therethough at least one removable fastener usable to temporarily secure such at least one removable engager to the at least one framing member. And, it provides such a wall-lifting system wherein such at least one set of fixed jaws comprises a clear opening width of about 3¼ inches.

Further, it provides such a wall-lifting system wherein: such at least one force-transfer bar holder comprises at least one fastening aperture structured and arranged to pass therethough at least one removable fastener usable to temporarily secure such at least one removable engager to such at least one force-transfer bar; and such at least one support bar holder comprises at least one fastening aperture structured and arranged to pass therethough at least one removable fastener usable to temporarily secure such at least one support bar holder to such at least one support bar.

Even further, it provides such a wall-lifting system wherein such at least one force-transfer bar holder, such at least one support bar holder, and such at least one removable engager share a common pivot axis. Moreover, it provides such a wall-lifting system wherein: such at least one pivot link comprises a substantially cylindrical shaft; such single shaft comprises at least one threaded end structured and arranged to receive at least one internally threaded fastener.

Additionally, it provides such a wall-lifting system wherein such at least one internally threaded fastener comprises at least one self-locking nut. Also, it provides such a wall-lifting system further comprising such at least one force-transfer bar. In addition, it provides such a wall-lifting system further comprising such at least one support bar. And, it provides such a wall-lifting system wherein such at least one force-transfer bar holder, such at least one support bar holder, and such at least one removable engager each substantially comprise a ferrous material.

In accordance with another preferred embodiment hereof, this invention provides a method of lifting at least one framed wall by at least one user comprising the steps of: providing at least one wall-lifting system structured and arranged to assist lifting of such at least one framed wall from a substantially horizontal position to a substantially vertical position; attaching such at least one wall-lifting system to at least one framing member of such at least one framed wall to be raised; manually applying to such at least one framed wall a first lifting force structured and arranged to lift such at least one framed wall from the substantially horizontal position to at least one intermediate position, wherein such lift comprises a rotation of such at least one framed wall about at least one bottom plate axis; temporarily supporting such at least one framed wall in such at least one intermediate position by at least one support bar of such at least one wall-lifting system, wherein such at least one support bar is adapted to freely rotate into a substantially vertical support position during lifting of such at least one framed wall to such at least one at least one intermediate position; using at least one force-transfer bar of such at least one wall-lifting system to raise such at least one framed wall from such at least one intermediate position to such at least one substantially vertical position by manually applying to such at least one framed wall a second lifting force. Further, it provides such a method further comprising the step of removing such at least one wall-lifting system from such at least one framed wall on completion of the lift.

In accordance with another preferred embodiment hereof, this invention provides a kit enabling the use of at least one intermediate support bar and at least one force-transfer bar to lift at least one framed wall from a substantially horizontal position to a substantially vertical position, such kit comprising: at least one force-transfer bar holder adapted to hold the at least one force-transfer bar; at least one support bar holder adapted to hold the at least one support bar; at least one removable engager adapted to removably engage at least one portion of the at least one framed wall; at least one pivot link structured and arranged to pivotally link such at least one force-transfer bar holder, such at least one support bar holder, and such at least one removable engager; and at least one set of instructions for use. Even further, it provides such a kit wherein such at least one force-transfer bar holder, such at least one support bar holder, such at least one removable engager, and such at least one pivot link are factory preassembled.

In accordance with another preferred embodiment hereof, this invention provides a wall-lifting system, relating to using at least one intermediate support bar and at least one force-transfer bar to lift at least one framed wall from a substantially horizontal position to a substantially vertical position, such system comprising: force-transfer bar holder means for holding such at least one force-transfer bar; support bar holder means for holding such at least one support bar; removable engager means for removably engaging at least one portion of the at least one framed wall; and pivot link means for pivotally linking such force-transfer bar holder means, such support bar holder means, and such removable engager means; wherein such pivot link means provides at least one independent rotation of each one of such force-transfer bar holder means, such support bar holder means, and such removable engager means. Even further, it provides such a wall-lifting system further comprising temporary fastener means for temporarily fastening such force-transfer bar holder means to the at least one force-transfer bar, such support bar holder means to the at least one support bar, and such removable engager means to the at least one portion of the at least one framed wall. Furthermore, it provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1A:
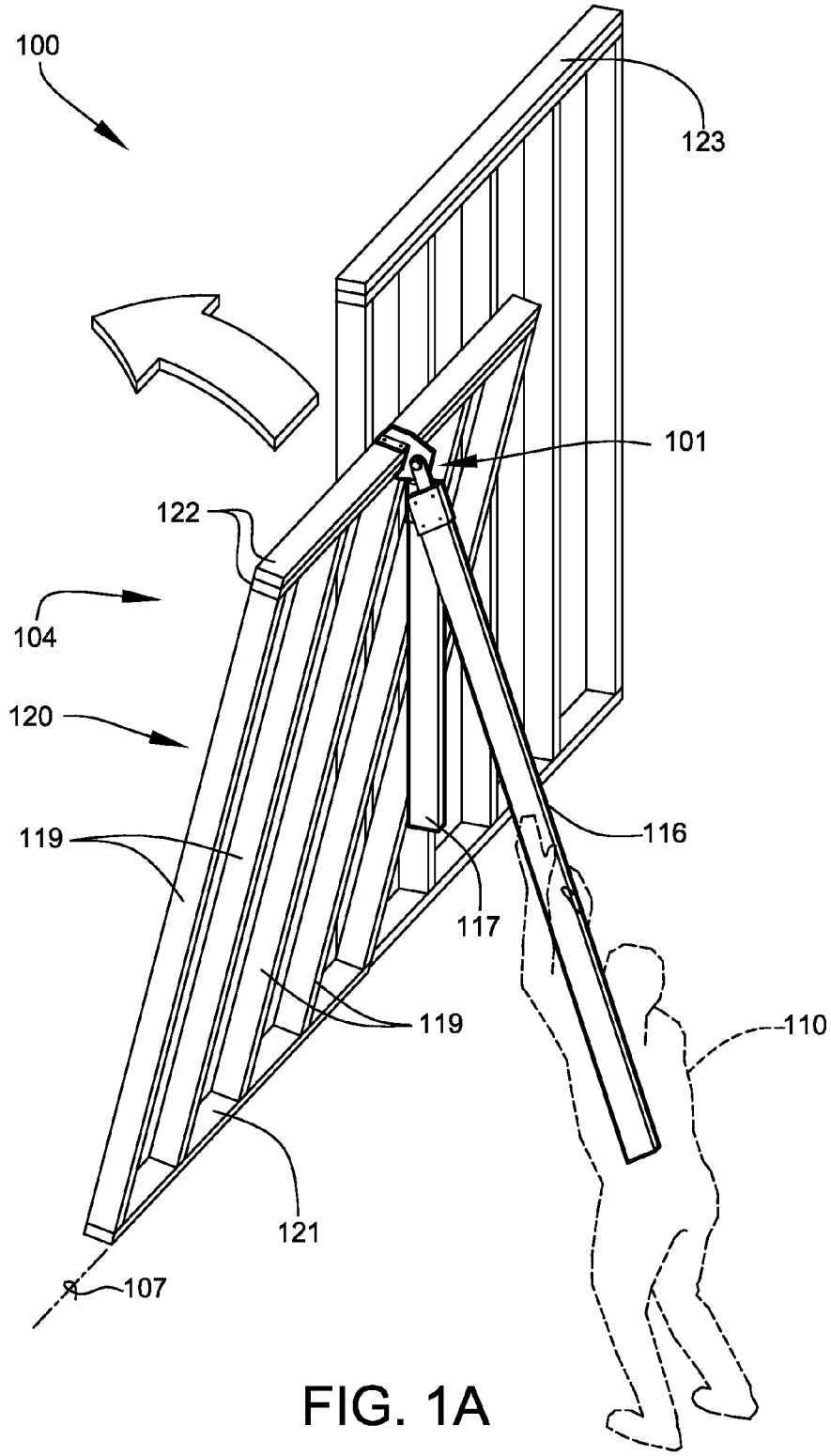
FIG. 1A shows a perspective view, illustrating a wall-lifting system engaged on a framed wall to assist in lifting the wall from a substantially horizontal position to a substantially vertical position, according to a preferred embodiment of the present invention.

Light-frame building construction is generally accomplished by the joining together of a plurality of partially assembled framed walls that are initially constructed horizontally and raised into their final vertical position. FIG. 1A shows a perspective view, illustrating wall-lifting system 100 engaged on wall framing 120 to assist in lifting the assembly from a substantially horizontal position to a substantially vertical position, according to a preferred embodiment of the present invention. Wall framing 120 is preferably constructed by assembling a plurality of structural studs 119, spaced at regular intervals between a pair of top plates 122 and at least one bottom plate 121 (also referred to as a sole plate), as shown. Studs 119, top plates 122, and bottom plate 121 are preferably formed from standardized dimensional wood lumber. Studs 119 may alternately comprise light-gauge steel members with upper and lower receiving tracks substituted for the top and bottom plates. Studs 119 are preferably attached perpendicularly to the top plates 122 and bottom plate 121 using nails or screws.

In North America, a commonly used framing material is dimensional wood lumber finished to a thickness of about 1½ inches and a width of at least about 3½ inches (comprising nominal dimensions notated as "two by four" inches). Considering such issues as design preference, user preferences, cost, structural requirements, available materials, wall insulation requirements, etc., alternate preferred lumber sizes such as, for example, wood lumber finished to a thickness of about 1½ inches and a width of about 5½ inches (a "two by six"), wood lumber finished to a thickness of about 1½ inches and a width of about 7¼ inches (a "two by eight"), etc., may suffice.

To enable rapid and efficient assembly, wall framing 120 is preferably assembled horizontally on a ground or floor surface. This allows the framer to move efficiently about the framing members during layout, squaring, and nailing of wall framing 120.

Wall framing 120 is preferably raised into place assisted, in part, by the application of a lifting force at the top of wall framing 120. The force is preferably applied through at least one lifting mount 101 preferably attached to the top plates 122 of wall framing 120, as shown. Lifting mount 101 is preferably secured to the top plates 122 using temporary fasteners 118, preferably double-headed (duplex) nails, preferably allowing for the removal of lifting mount 101 after the lift is completed. The lifting force is preferably provided by the manual manipulation of lifting mount 101 by user 110. An elongated force-transfer bar 116 is preferably coupled to lifting mount 101, preferably by engagement within one of two articulated receiving sockets, preferably enabling user 110 to apply a lifting force above the normal reach of user 110, as shown.

The application of force by user 110 on force-transfer bar 116 results in the upward rotation of wall framing 120 about the longitudinal axis 107 located on or near bottom plate 121, as shown. A shorter support bar 117 is preferably coupled to lifting mount 101, preferably by engagement within a second of the two articulated receiving sockets, preferably providing safety-enhancing intermediate support of wall framing 120 during the lift. Wall-lifting system 100 is preferably removed from top plate 122 once the lifting operation is complete. A more complete explanation of a preferred lifting sequence is provided in FIG. 5.

Figure 2:
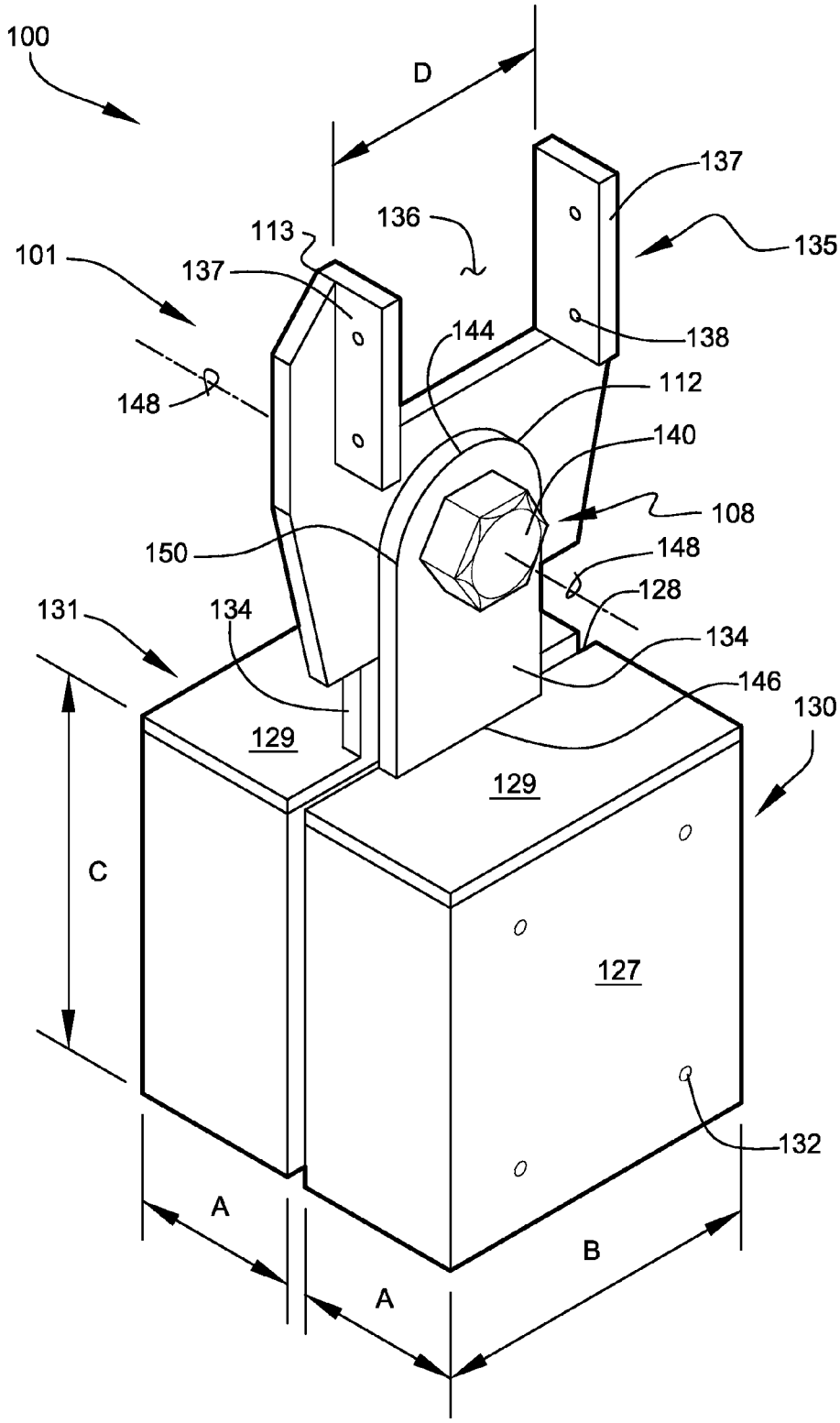
FIG. 2 shows a perspective view illustrating a lifting mount of the wall-lifting system, according to the preferred embodiment of FIG. 1B.
Figure 3:
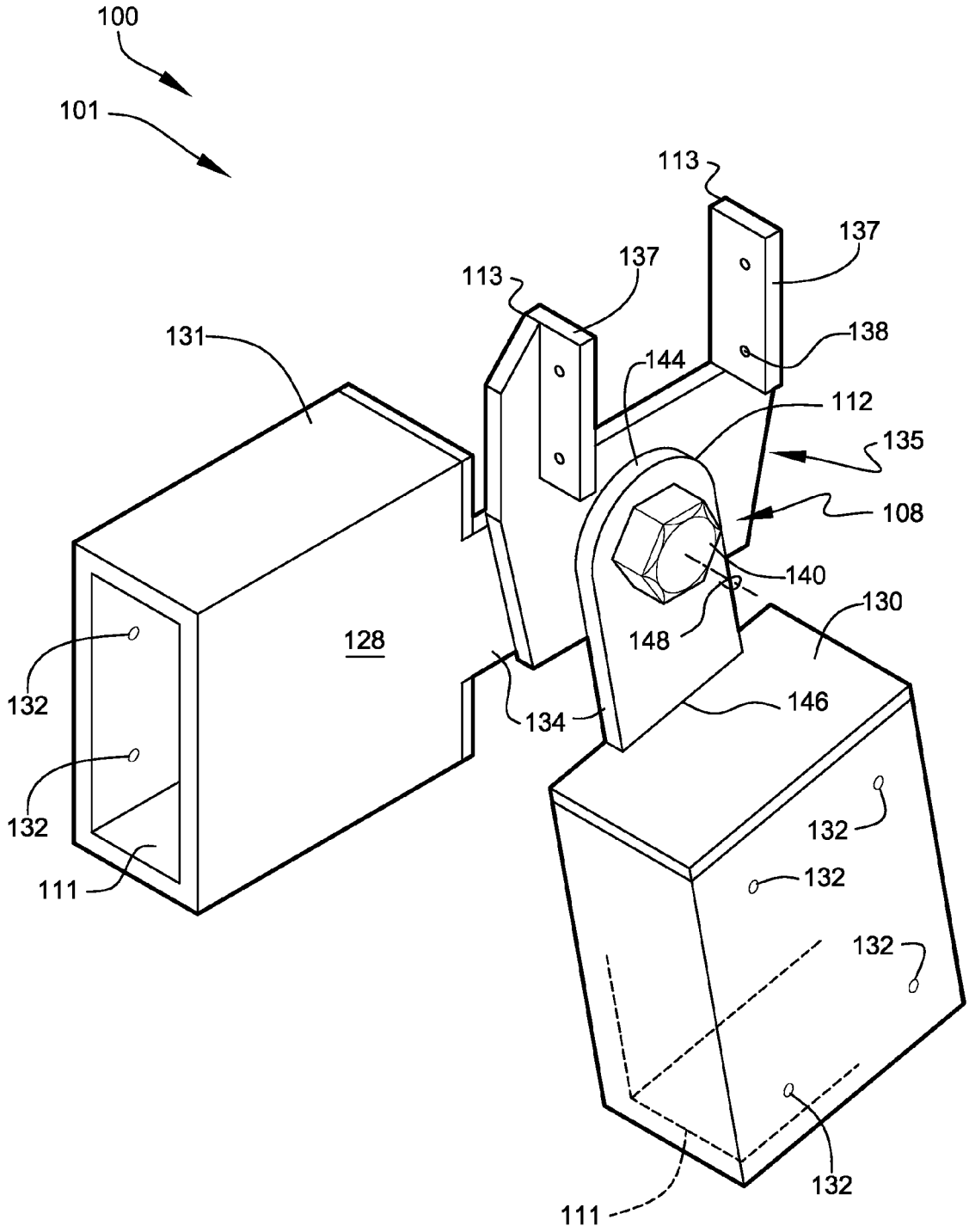
FIG. 3 shows a perspective view, illustrating the lifting mount in a partially articulated configuration, according to the preferred embodiment of FIG. 2.

FIG. 2 shows a perspective view illustrating lifting mount 101 of wall-lifting system 100. FIG. 3 shows a perspective view, illustrating lifting mount 101, according to the preferred embodiment of FIG. 2. The embodiment orientation of FIG. 3 shows the rotational capability between the components of lifting mount 101. As user 110 raises wall framing 120, the angles between each component of wall-lifting system 100 preferably change relative to each other.

Figure 4:
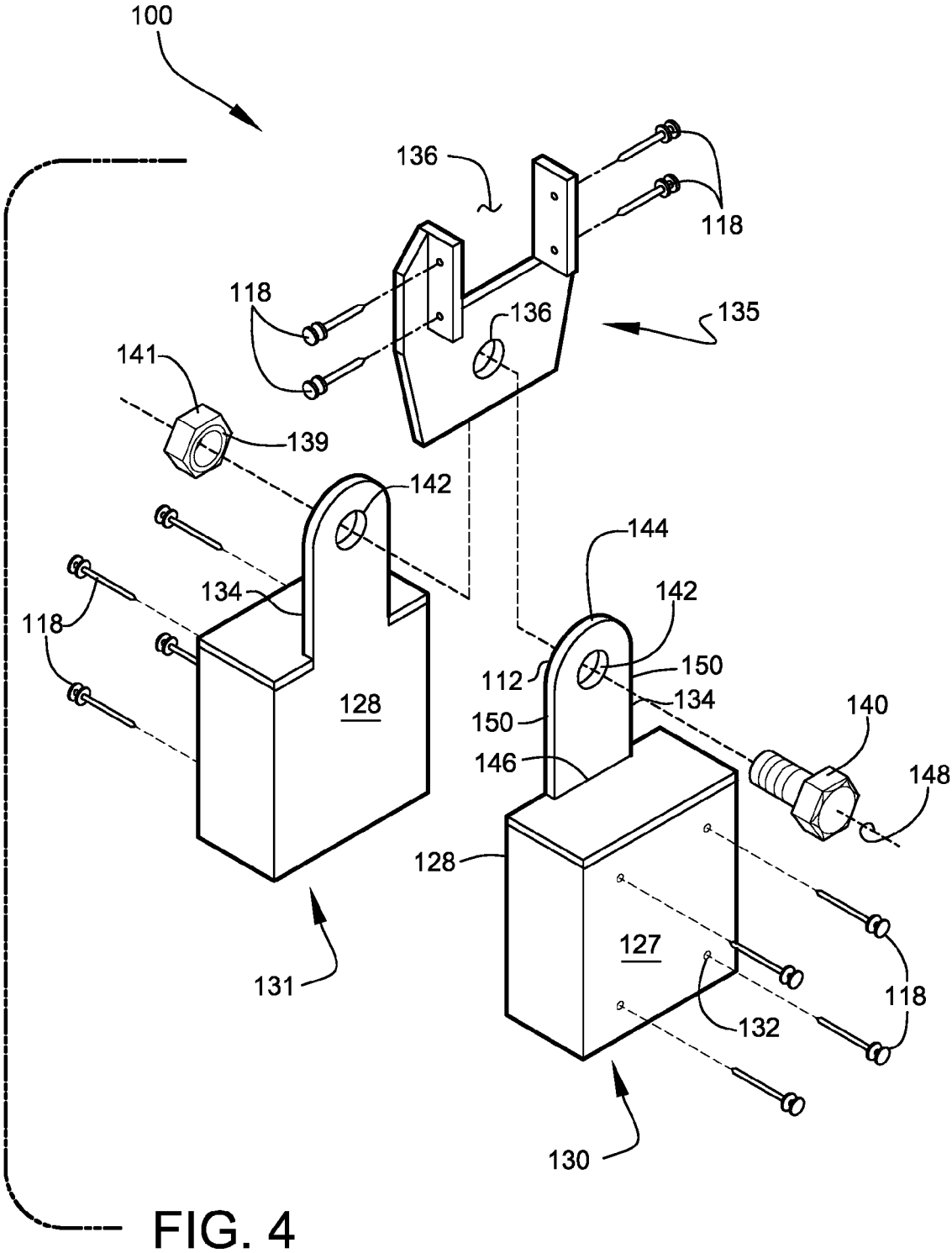
FIG. 4 shows an exploded view illustrating preferred components of the lifting mount of FIG. 2.

Lifting mount 101 preferably comprises three principal components generally identified herein as first bar receiver 131, second bar receiver 130, and attacher 135, as shown. In addition, lifting mount 101 preferably comprises a transverse pivot fastener 108 adapted to pivotally join the three principal components along a common pivot axis 148, as shown. Transverse pivot fastener 108 preferably comprises a cylindrical shaft, most preferably a threaded bolt 140 and nut 141, as shown. Bolt 140 preferably comprises a mild-steel fastener having a length of about 2-inch and an outside diameter of about ⅝-inch. A course thread pitch is also preferred. Nut 141 preferably comprises a self-locking feature, preferably comprising at least one internal screw thread comprising a thermoplastic, more preferably a nylon insert 139, as shown in FIG. 4. Nylon insert 139 preferably functions to generate a frictional resistance to turning reducing the likelihood of a separation of nut 141 from bolt 140 during use.

Nut 141 is preferably threaded onto bolt 140 and preferably tightened to a "snug fit" to prevent loss during operation; however, it is preferred that nut 141 not be tightened to the point that the resulting friction impedes rotation of the three primary components. Upon reading this specification, those with ordinary skill in the art will now appreciate that, under appropriate circumstances, considering such issues as design preference, user preferences, marketing preferences, cost, structural requirements, available materials, technological advances, etc., other nut holding/locking means such as, for example, jam nut, castellated nut, nylon washer, bearing, etc., may suffice. Furthermore, upon reading this specification, those with ordinary skill in the art will now appreciate that, under appropriate circumstances, considering such issues as design preference, user preferences, marketing preferences, cost, structural requirements, available materials, technological advances, etc., other linking arrangements such as, for example, other pivot joiners, clevises, permanently welded rods and pins, magnets, rivets, clamps, clasps, etc., may suffice.

First bar receiver 131 and second bar receiver 130 each preferably comprise a hollow interior receiving socket 111 adapted to receive an end portion of a respective bar, as shown. In a preferred arrangement, support bar 117 and the longer force-transfer bar 116 both comprise standard dimensional wood members, preferably "two-by-four" wood members having a nominal width of about four inches and a nominal thickness of about two inches. Receiving socket 111 is preferably sized to closely fit this preferred wood lumber dimension, with additional clearance preferably provided to accommodate minor variations in member sizing.

First bar receiver 131 and second bar receiver 130 are each preferably fabricated from mild steel plates preferably having a thickness of about 3/16 inch. The plates are preferably joined by thermal welding. First bar receiver 131 and second bar receiver 130 each preferably comprise an outer width A of about two inches, a preferred length B of about four inches and a preferred outer height C of about four inches. An end-cap 129 is preferably welded to the upper ends of first bar receiver 131 and second bar receiver 130 to act as a stop to limit forward passage of the force-transfer bar 116 through the receiving sockets 111. Upon reading this specification, those with ordinary skill in the art will now appreciate that, under appropriate circumstances, considering such issues as design preference, user preferences, cost, structural requirements, available materials, technological advances, etc., other force-transfer bar holder arrangements, such as, for example, using tube steel sections, using alternate bar and holder shapes, made from ferrous or non-ferrous materials, composites, plastic, etc., may suffice.

First bar receiver 131 and second bar receiver 130 each preferably comprise a projecting lug 134 preferably functioning as a fixed support for the pivotal mounting of attacher 135, as shown. Each lug 134 preferably comprises a flat steel bar having a thickness of about 3/16 inch. Each lug 134 preferably comprises a base width of about two inches and is preferably formed by extending a central portion of outer wall 128 upwardly beyond end-cap 129, as shown. Each lug 134 comprises an upper terminating radius 112 having a lug apex 144 preferably located about three inches above lug base 146. Two outer tangential edges 150 transition to the upper terminating radius 112 at a height of about 2½ inches above lug base 146, as shown. Upon reading this specification, those with ordinary skill in the art will now appreciate that, under appropriate circumstances, considering such issues as design preference, user preferences, marketing preferences, cost, structural requirements, available materials, technological advances, etc., other lugs of various shapes, sizes and assembly methods such as, for example, elliptical, square, polygonal, lugs of different heights, widths, and one-piece molded holder and lug combinations, etc., may suffice.

Each lug 134 preferably comprises aperture 142, preferably formed during the manufacturing process. Aperture 142 is preferably sized to allow the passage of transverse pivot fastener 108, preferably comprising the ⅝-inch diameter bolt 140. Aperture 142 is preferably punched about 2-inches vertically from lug base 146, preferably along vertical centerline 152 of lug 134, as shown in FIG. 4. Upon reading this specification, those with ordinary skill in the art will now appreciate that, under appropriate circumstances, considering such issues as design preference, user preferences, marketing preferences, cost, structural requirements, available materials, technological advances, etc., other hole-forming methods of manufacture, such as, for example, drilled holes, molded holes, etc., may suffice.

At least one fastener hole 132 is preferably pre-drilled into both first bar receiver 131 and second bar receiver 130, during the manufacturing process. Each of the bar receivers preferably comprise four fastener holes 132 that are preferably located within outer wall 127 opposite outer wall 128, as shown. This preferred positioning allows user 110 convenient access to both position and install temporary fasteners 118 through first bar receiver 131 into support bar 117 and through second bar receiver 130 into force-transfer bar 116. Upon reading this specification, those with ordinary skill in the art will now appreciate that, under appropriate circumstances, considering such issues as design preference, user preferences, marketing preferences, cost, structural requirements, available materials, technological advances, etc., other hole manufacturing methods such as, for example, punched, molded, etc., may suffice.

The rotatable attacher 135 preferably comprises a generally U-shaped central member having a set of laterally spaced fixed jaws 137, as shown. The central member of attacher 135 is preferably constructed from mild steel plate having a thickness of about ¼ inch. A centrally located aperture 136 (see FIG. 4) allows for the passage of bolt 140 during assembly of lifting mount 101.

Figure 1B:
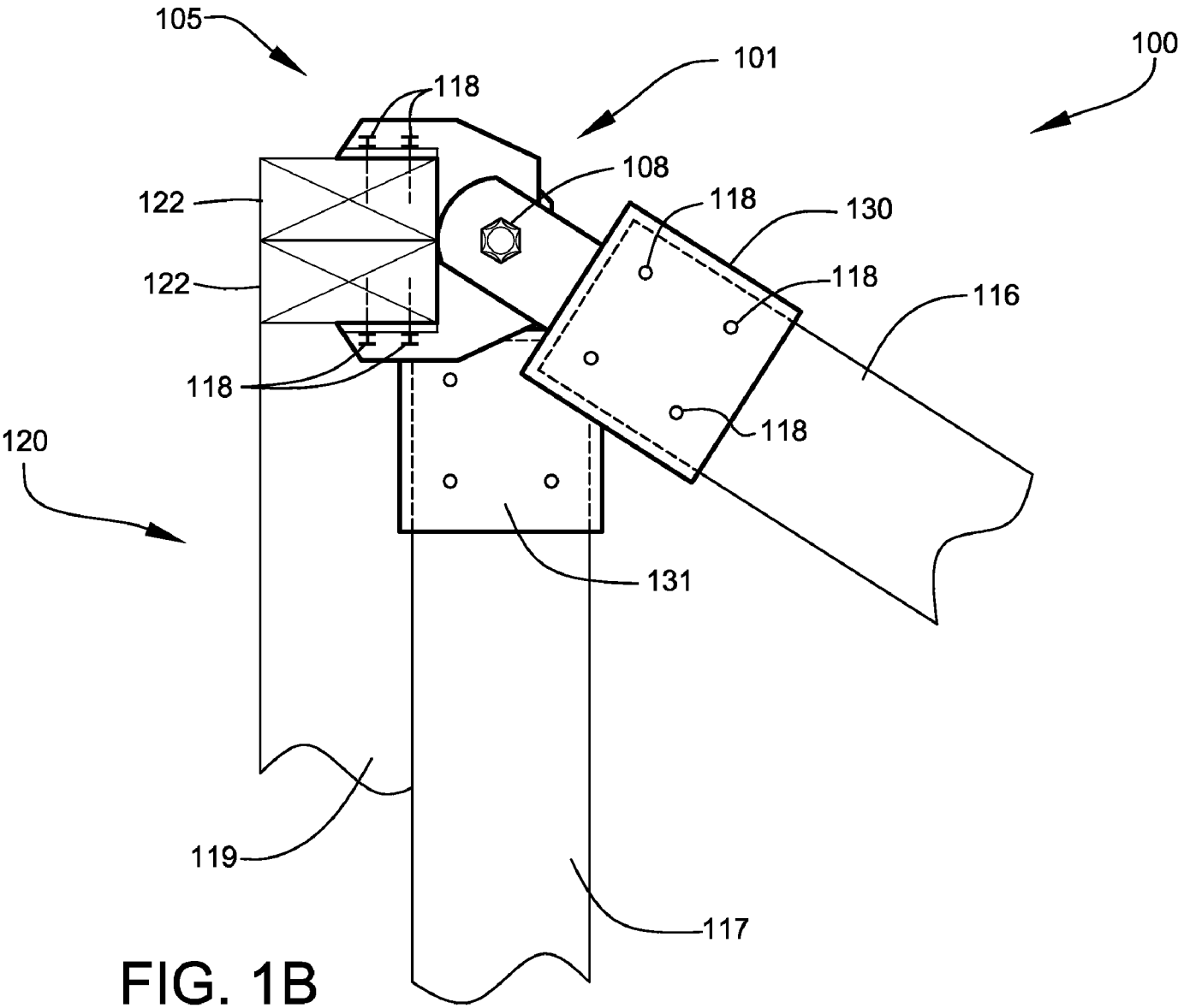
FIG. 1B shows an enlarged side view of the lifting mount, attached to a top plate of a vertically positioned wall, according to the preferred embodiment of FIG. 1A.

Jaws 137 are preferably adapted to engage opposite sides of the top plates 122, as shown in both FIG. 1A and FIG. 1B. Jaws 137 of attacher 135 are preferably arranged in a substantially parallel orientation, preferably comprising a clear opening width D of about 3¼ inches. This preferred spacing accommodates the double top plates 122 customary in such framing.

Each jaw 137 preferably comprises an enlarged contact face preferably formed from a rectangular steel plate projecting outwardly from attacher 135, as shown. Each jaw 137 preferably comprises mild steel having a preferred thickness of about ⅛ inch, a preferred width of about one inch, and a preferred length of about two inches. The long length of each jaw 137 is preferably welded flush to edge 113 of attacher 135, as shown in FIGS. 2-4. Each jaw 137 preferably comprises pair of fastener holes 138 to preferably provide a means for securing attacher 135 to top plate 122 using temporary fasteners 118.

FIG. 4 shows an exploded view, illustrating lifting mount 101 of wall-lifting system 100, according to the preferred embodiment of FIG. 2. First bar receiver 131, second bar receiver 130 and attacher 135 preferably share a common axis of rotation 148 at bolt 140, as shown. First bar receiver 131 and second bar receiver 130 are preferably assembled "back-to-back" as symmetrically mirrored components, as shown. In a preferred assembly of lifting mount 101, bolt 140 is preferably passed through aperture 142 of lug 134 of first bar receiver 131, aperture 136 of attacher 135, and aperture 142 of lug 134 of second bar receiver 130. Nut 142 is preferably threaded onto bolt 140 to hold lifting mount 101 together, while still permitting freedom of rotation of all connected members.

A metal inert gas welder, hereinafter "MIG welder", is the preferred means for welding components used in the preferred embodiment of the present invention. The MIG welder is preferably used to perform welding on mild steel material of wall-lifting system 100 to minimize warping and maximize efficiency during the manufacturing process. Upon reading this specification, those with ordinary skill in the art will now appreciate that, under appropriate circumstances, considering such issues as design preference, user preferences, marketing preferences, cost, structural requirements, available materials, technological advances, etc., other welding processes such as, for example, other forms of welding including arc welding, gas welding, TIG welding, etc., may suffice.

Unless noted otherwise, lifting mount 101 is preferably constructed from mild steel such as AISI 1018, preferably comprising a carbon content of about 0.16-0.29% to provide strength, durability, good welding characteristics, and relative economy. Upon reading this specification, those with ordinary skill in the art will now appreciate that, under appropriate circumstances, considering such issues as design preference, user preferences, marketing preferences, cost, structural requirements, available materials, technological advances, etc., other materials may be used such as, for example, other mild steels, high-strength steel, various steel compositions with different carbon content and/or heat-treatments, other non-ferrous materials, molded plastics, etc., may suffice.

Figure 5:
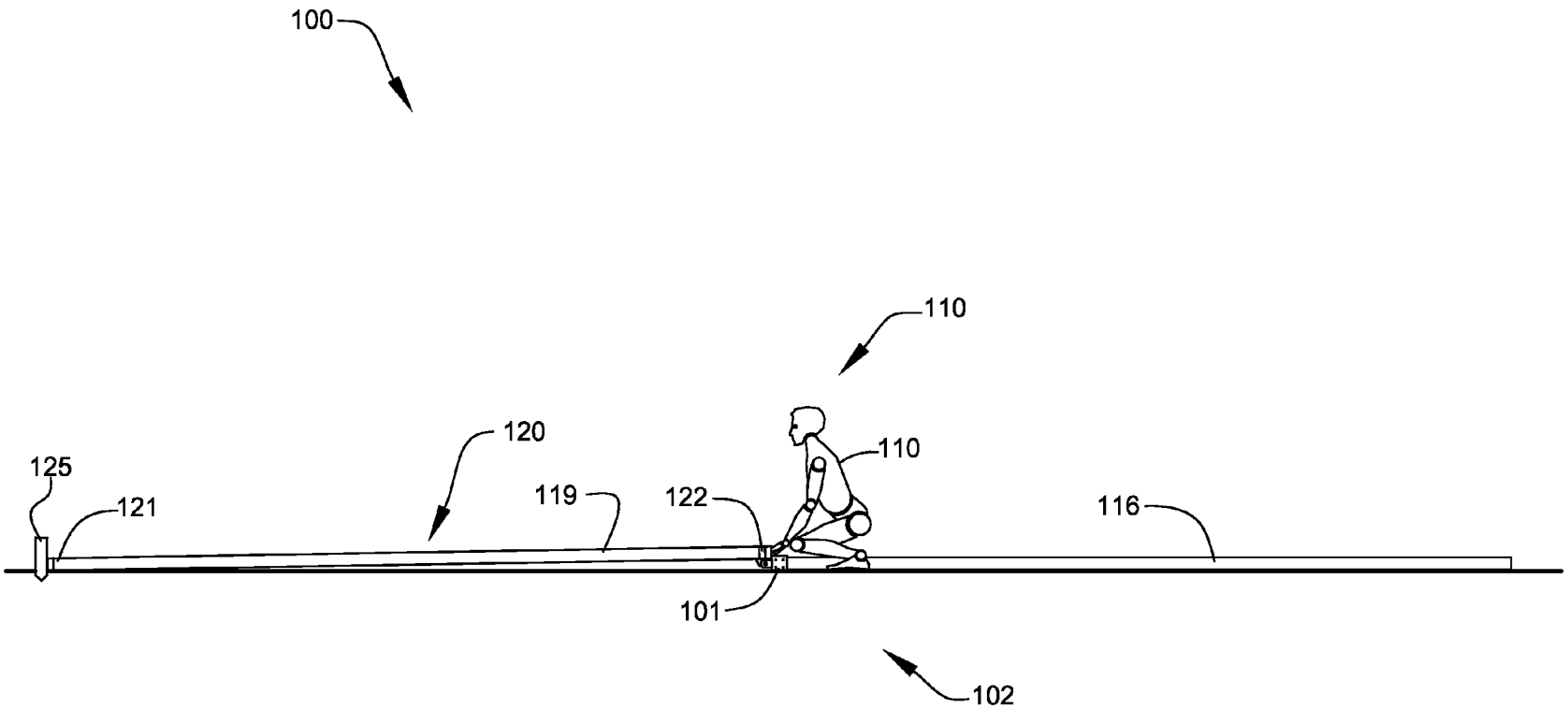
FIG. 5 shows a diagrammatic side view of the wall-lifting system, mounted to a framed wall in a substantially horizontal, starting position, according to the preferred embodiment of FIG. 1B.

The following illustrations describe, in greater detail, a preferred wall-lifting sequence using lifting mount 101. FIG. 5 shows a side view of wall-lifting system 100 with lifting mount 101 attached to wall framing 120 in the horizontal (starting) position 102, according to the preferred embodiment of FIG. 2.

Wall framing 120 is preferably fabricated horizontally on the ground or floor surface during the initial phase of building construction. Once the framing of wall framing 120 is substantially complete, wall framing 120 is preferably raised from its horizontal position 102 to a vertical position preferably allowing wall framing 120 to be fastened to the remainder of structure 123, as shown in FIG. 1A.

In an initial preferred step, user 110 preferably attaches lifting mount 101 to wall framing 120, in the manner previously discussed. Next, user 110 preferably attaches support bar 117 and force-transfer bar 116 to lifting mount 101 as previously described. In the next preferred step, user 110 preferably grasps wall framing 120, preferably by grasping top plates 122, as shown, and preferably applies a first lifting force to lift wall framing 120, thereby beginning a preferred rotation of the wall about the base of bottom plate 121. Ideally, the position of bottom plate 121 is preferably maintained by at least one holder-stake 125 preferably placed in front of bottom plate 121 to preferably prevent forward movement of wall framing 120 as user 110 performs the lift. Another preferred option to prevent wall framing 120 from moving forward, while lifting and rotating, is to have at least one other user 110 preferably firmly hold wall framing 120 preferably close to its point of rotation, preferably near bottom plate 122.

Figure 6:
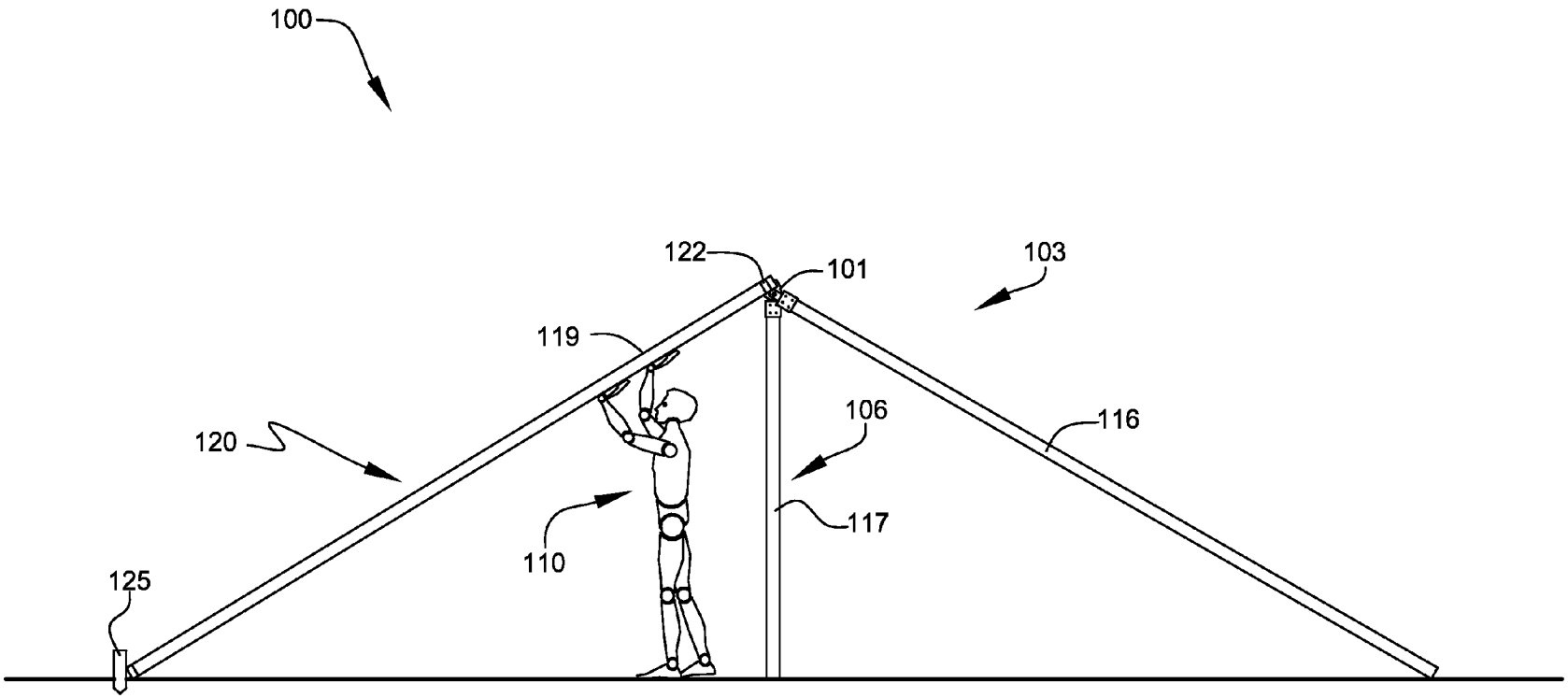
FIG. 6 shows a diagrammatic side view of the wall-lifting system, assisting a user in the lifting of the framed wall to a partially-raised and supported position, according to the preferred embodiment of FIG. 1B.

FIG. 6 shows a side view of wall-lifting system 100, attached to wall framing 120 in a semi-vertical (intermediate), second-raised position 103, according to the preferred embodiment of FIG. 2. Continuing from the preferred steps of FIG. 5, user 110 continues to manually lift wall framing 120 by moving hand over hand down the framing members, preferably advancing along one or more studs 119, preferably while walking forward, preferably beginning nearest top plate 122, as shown, and preferably "walking" towards bottom plate 121. Wall framing 120 is thereby lifted from its original resting horizontal position 102, to a point where support bar 117 has preferably rotated and dropped into the vertical safety position 106, as shown. Support bar 117 is preferably attached as previously described, so it has no alternative other than to rotate, and "follow and drop" into position under the force of gravity.

Once support bar 117 has preferably reached vertical safety position 106, user 110 preferably lets the full weight of wall framing 120 safely rest on support bar 117. This preferably provides user 110 with a preferred safe intermediate resting point. An intermediate resting point, as shown, also protects materials of wall framing 120, should user 110 become fatigued and would otherwise drop wall framing 120 before reaching vertical position 105. The advantages of such a wall-lifting system 100 are compounded with multistory constructions, as the weight of wall framing 120 is increased and must be lifted to a higher position before preferred fastening to adjacent structure 123 can take place.

The safety aspects of the present invention will reduce job-site injuries and reduce construction costs. Consequently, insurance costs may be significantly decreased. In addition, the framed walls may be safely lifted using fewer workers, thus decreasing labor costs.

Figure 7:
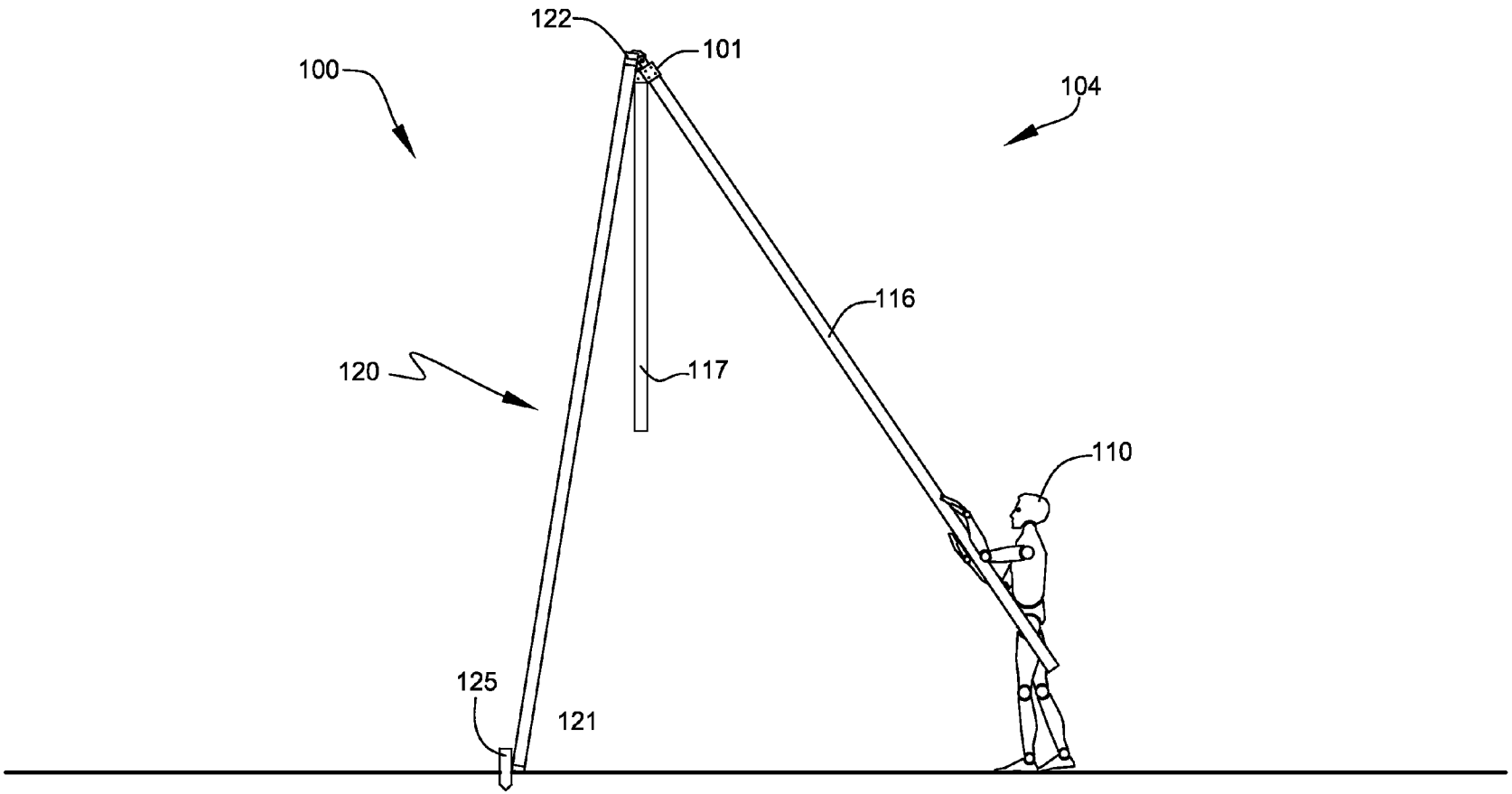
FIG. 7 shows a diagrammatic side view of the wall-lifting system, assisting the user in the lifting of the framed wall to a near vertical orientation, according to the preferred embodiment of FIG. 1B.

The longer force-transfer bar 116 also preferably follows to a ready position, as shown in FIG. 6. User 110 preferably exits from under the supported wall framing 120, to take up the new preferred position adjacent force-transfer bar 116, as shown in FIG. 7. Upon reading this specification, those with ordinary skill in the art will now appreciate that, under appropriate circumstances, considering such issues as design preference, user preferences, marketing preferences, cost, structural requirements, available materials, technological advances, etc., other force-transfer bar qualities such as, for example, force-transfer bars may be cut to different lengths according to wall height, user height, strength and preference, etc., may suffice.

FIG. 7 shows a side view of wall-lifting system 100, attached to wall framing 120 in the substantially vertical third-raised position 104, according to the preferred embodiment of FIG. 2. Continuing in sequence from FIG. 6, user 110 preferably grips and preferably firmly holds force-transfer bar 116 and preferably walks forward, preferably applying a second lifting force to framed wall 120 to continue the upward rotation of the wall around bottom plate 121, preferably lifting framed wall 120 into third-raised position 104. User 110 is in a preferred position of relative safety at this stage, as wall framing 120 is preferably at an increased distance from user 110. Force-transfer bar 116 is preferably of sufficient length to preferably allow accurate and precise manipulation of wall framing 120.

Preferably, once wall framing 120 is in vertical position 105, wall framing 120 is preferably secured to structure 123. Once wall framing 120 has been fastened to structure 123, wall-lifting mount 101 is preferably removed.

Reference is again made to the illustration of FIG. 1B, showing wall framing 120 at the completion of the lift, preferably comprising a substantially vertical orientation, with lifting mount 101 still attached to top plates 122 of wall framing 120. Continuing in sequence from FIG. 7, lifting mount 101 is preferably detached on completion of the lift by preferably removing temporary fasteners 118 that preferably connect jaws 137 to top plate 122. User 110 preferably retains lifting mount 101 for subsequent use. The standard dimensional sizing of support bar 117 and force-transfer bar 116 provides user 110 with the option of saving support bar 117 and force-transfer bar 116 for future use, or fabricating new force-transfer bars at subsequent construction jobsites.

An alternate preferred method of use of wall-lifting system 100 may be applied when a plurality of users 110 are available to lift a single story wall framing 120. In this alternate preferred method, a plurality of lifting mounts 101 are engaged to the top plates of a framed wall to preferably distribute the lifting load among the plurality of users 110. For example, if two wall-lifting systems 100 are preferably attached to top plate 122, then preferably two or more users 110 may preferably combine their efforts to raise such wall framing 120. For this alternately preferred method to work effectively, wall-lifting systems 100 must preferably be attached to top plate 122 preferably symmetrically from side to side, more specifically, if a first lifting mount 101 is attached at a point three feet from a first end of wall framing 120, a second lifting mount 101 must preferably be attached at a point three feet from the second (opposite) end of the same wall framing 120. Further, each force-transfer bar 116 should preferably comprise substantially identical lengths; thus, preferably allowing wall framing 120 to be raised evenly.

In instances where more than one wall framing 120 is preferably pre-assembled and preferably fastened "one on top of the other", lifting mount 101 may preferably have a larger clear space between jaws 137 to preferably allow attachment over multiple top plates 122 and a bottom plate 121.

This particular alternate preferred method of use preferably uses a longer support bar 117 and preferably a longer force-transfer bar 116 for preferred use on upper wall framing 120, to preferably compensate for the increased lifting distance. This alternate preferred method of use is accomplished preferably employing a plurality of users 110 to provide the maximum safety. Cross-bracing may preferably be used for added shear strength. Various jacking assisters may also be used in combination with the described alternately preferred methods to further enhance safety of such an endeavor. Upon reading this specification, those with ordinary skill in the art will now appreciate that, under appropriate circumstances, considering such issues as design preference, user preferences, marketing preferences, cost, structural requirements, available materials, technological advances, etc., other joint strengthening as would be used between multiple-story wall sections such as, for example, other bracing configurations, clamps and various forms of jacks, etc., may suffice.

Figure 8:
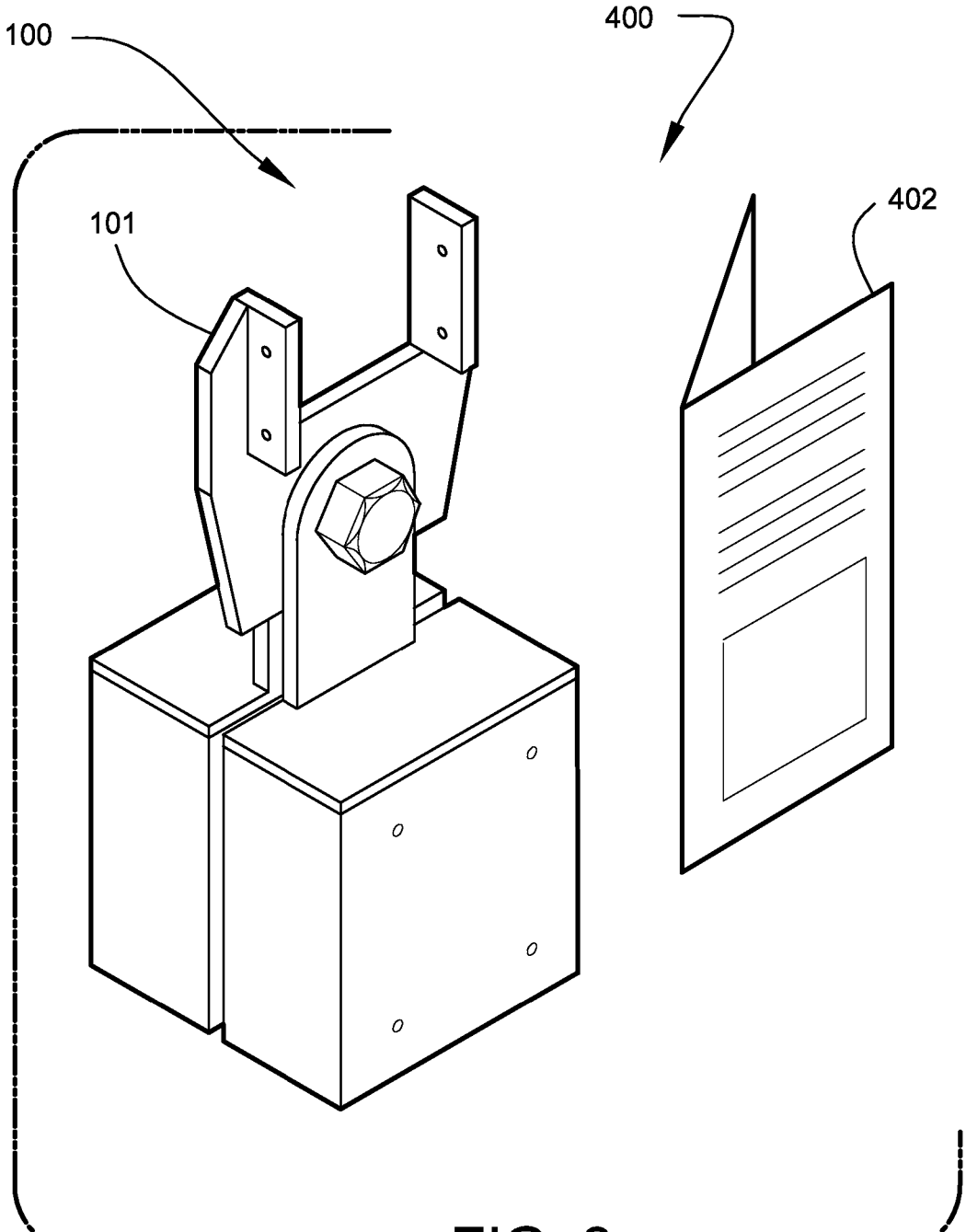
FIG. 8 shows a diagram representing the contents of a kit, containing the lifting mount of FIG. 1A, according to a preferred embodiment of the present invention.

FIG. 8 shows a diagram representing the contents of kit 400, containing at least one lifting mount 101 of FIG. 1A, according to a preferred embodiment of the present invention. In addition to at least one lifting mount 101, kit 400 preferably comprises a set of user instructions 402, as shown. Lifting mount 101 of kit 400 may preferably be supplied factory-preassembled, as shown, or may preferably be supplied as separated components. Upon reading this specification, those with ordinary skill in the art will now appreciate that, under appropriate circumstances, considering such issues as cost, user preference, etc., other kit arrangements such as, for example, supplying a plurality of kits allowing users to interchange individual components of the lifting mount to accommodate alternate lumber sizes, alternate bar shapes, etc., may suffice.

Figures 9, 10:
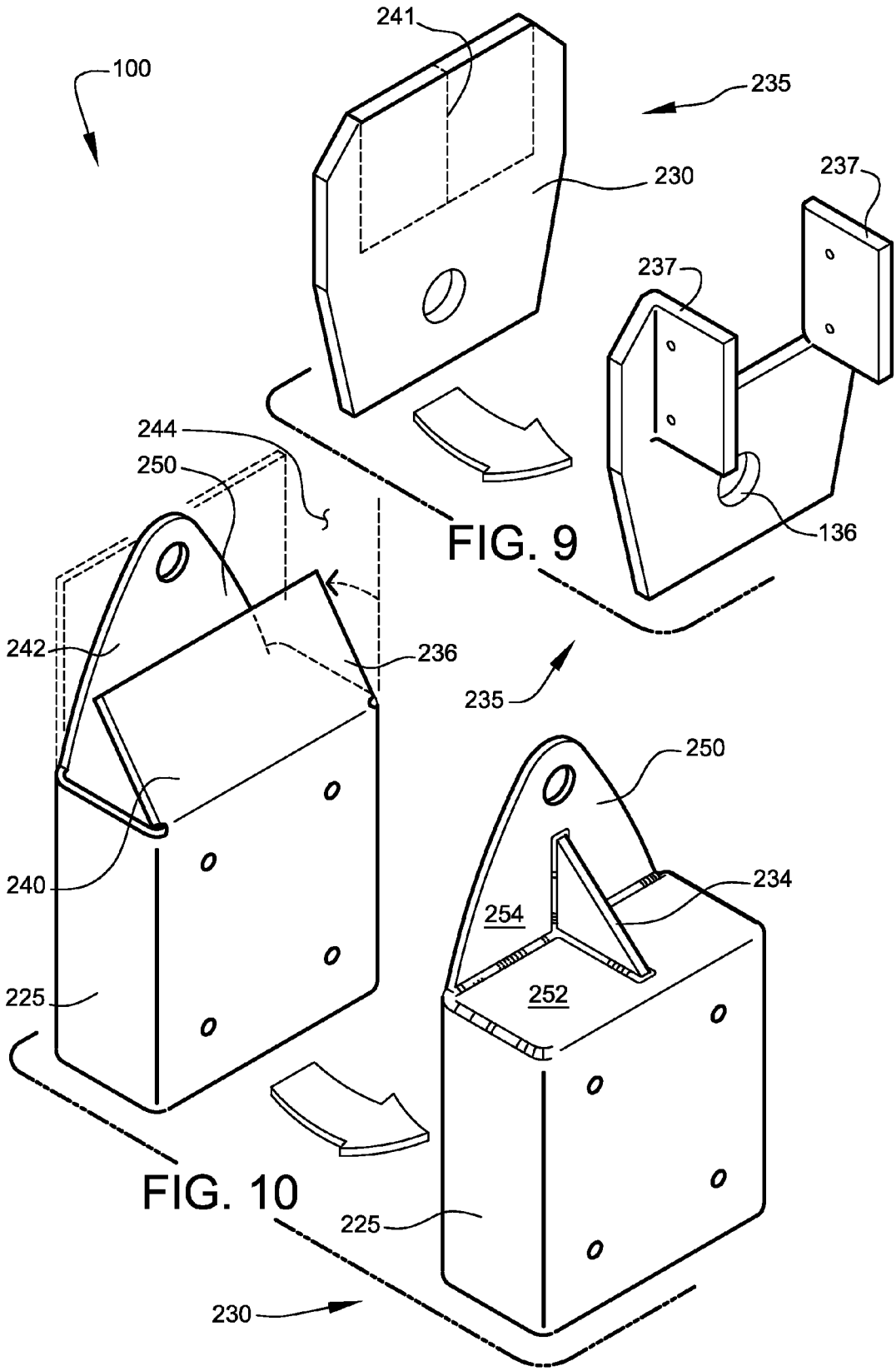
FIG. 9 shows a perspective view illustrating a preferred method of making the rotatable attacher of the wall-lifting system, according to another preferred embodiment of the present invention.
FIG. 10 shows a perspective view, illustrating a preferred method of making the bar receiver of the wall-lifting system, according to another preferred embodiment of the present invention.

FIG. 9 shows a perspective view illustrating a preferred method of making the rotatable attacher 235 of the wall-lifting system 100, according to another preferred embodiment of the present invention.

The rotatable attacher 235 preferably comprises a generally U-shaped central member having a set of laterally spaced fixed jaws 237, as shown. The central member of attacher 235 is preferably constructed from mild steel plate having a thickness of about ¼ inch. A centrally located aperture 136 (see FIG. 4) allows for the passage of bolt 140 during assembly of lifting mount 101, as shown. In an alternate preferred embodiment, jaws 237 are made by cutting out jaws 237 in a pattern 241 (see dotted lines) from unitary plate 230 and bending jaws 237 from the unitary plate 230, as shown. Upon reading this specification, those with ordinary skill in the art will now appreciate that, under appropriate circumstances, considering such issues as design preference, user preferences, marketing preferences, cost, structural requirements, available materials, technological advances, etc., other jaw forming arrangements such as, for example, laser cutting, machine punch, etc., may suffice.

FIG. 10 shows a perspective view, illustrating a preferred method of making the bar receiver 230 of the wall-lifting system 100, according to another preferred embodiment of the present invention. As shown in FIG. 10, both first bar receiver 131 and second bar receiver 130 described above may alternately preferably be made as shown by receiver 230. Preferably, receiver 230 is made using steel tubing 225, preferably rectangular steel tubing, as shown. A portion 236 of steel tubing 225 is preferably cut to form an end flap 240 and an opposed portion 242, with the traverse ends 244 (only one shown in dotted lines) of the steel tube 225 removed then preferably folded 90-degrees and preferably welded to opposed portion 242, which preferably becomes lug 250, as shown.

Preferably, an additional structural support 234, preferably at least one gusset, preferably steel (preferably the same material as receiver 230) is welded both to the top 252 of receiver 230 and to the side 254 of lug 250, as shown. By providing additional structural support 234, receiver 230 is strengthened, particularly to assist resisting bending forces that may occur to lug 250 during use of receiver 230 during lifting, as shown. Lug 250 is preferably made using opposed portion 242, also preferably cut away from steel tube 225, as shown. In addition, structural support 234 may be taken from traverse ends 244 scrap, as shown.

Receiver 230 is preferably fabricated from steel tubing preferably having a thickness of between about ⅛ inch and about ¼ inch; however, use of one or more structural support 234 allows for thinner materials (with higher resistance to bending). Upon reading this specification, those with ordinary skill in the art will now appreciate that, under appropriate circumstances, considering such issues as design preference, user preferences, cost, structural requirements, available materials, technological advances, etc., other force-transfer bar holder arrangements, such as, for example, using tube steel sections, using alternate bar and holder shapes, made from ferrous or non-ferrous materials, composites, plastic, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A wall-lifting system, relating to using at least one intermediate support bar and at least one force-transfer bar to lift at least one framed wall from a substantially horizontal position to a substantially vertical position, said system comprising:

a) at least one force-transfer bar holder structured and arranged to hold such at least one force-transfer bar;

b) at least one support bar holder structured and arranged to hold such at least one support bar;

c) at least one removable engager structured and arranged to removably engage at least one portion of the at least one framed wall; and d) at least one pivot link structured and arranged to pivotally link said at least one force-transfer bar holder, said at least one support bar holder, and said at least one removable engager;

e) wherein said at least one pivot link is structured and arranged to provide at least one independent rotation of each one of said at least one force-transfer bar holder, said at least one support bar holder, and said at least one removable engager;

f) wherein said at least one removable engager comprises at least one set of fixed jaws structured and arranged to engage opposing sides of at least one framing member of the at least one framed wall;

g) wherein said at least one set of fixed jaws comprises at least one fastening aperture structured and arranged to pass therethrough at least one removable fastener usable to temporarily secure said at least one removable engager to the at least one framing member; and h) wherein said at least one force-transfer bar holder, said at least one support bar holder, and said at least one removable engager share a common pivot axis.

2. The wall-lifting system according to claim 1 wherein said at least one force-transfer bar holder and said at least one support bar holder each comprise at least one socket structured and arranged to engage at least one standard dimensional wood member.

3. The wall-lifting system according to claim 1 wherein said at least one force-transfer bar holder and said at least one support bar holder each comprise at least one socket structured and arranged to engage at least one standard dimensional wood member having a nominal width of about four inches and a nominal thickness of about two inches.

4. The wall-lifting system according to claim 1 wherein said at least one set of fixed jaws comprises a clear opening width of about 3¼ inches.

5. The wall-lifting system according to claim 1 wherein:

a) said at least one force-transfer bar holder comprises at least one fastening aperture structured and arranged to pass therethrough at least one removable fastener usable to temporarily secure said at least one removable engager to such at least one force-transfer bar; and b) said at least one support bar holder comprises at least one fastening aperture structured and arranged to pass therethrough at least one removable fastener usable to temporarily secure said at least one support bar holder to such at least one support bar.

6. The wall-lifting system according to claim 1 wherein:

a) said at least one pivot link comprises a substantially cylindrical shaft;

b) said single shaft comprises at least one threaded end structured and arranged to receive at least one internally threaded fastener.

7. The wall-lifting system according to claim 6 wherein said at least one internally threaded fastener comprises at least one self-locking nut.

8. The wall-lifting system according to claim 4 further comprising such at least one force-transfer bar.

9. The wall-lifting system according to claim 4 further comprising such at least one support bar.

10. The wall-lifting system according to claim 1 wherein said at least one force-transfer bar holder, said at least one support bar holder, and said at least one removable engager each substantially comprise a ferrous material.

11. The wall-lifting system according to claim 1 wherein said at least one force-transfer bar holder and said at least one support bar holder each comprise rectangular tube steel.

12. A method of lifting at least one framed wall by at least one user comprising the steps of:

a) providing at least one wall-lifting system structured and arranged to assist lifting of such at least one framed wall from a substantially horizontal position to a substantially vertical position;

b) attaching such at least one wall-lifting system to at least one framing member of such at least one framed wall to be raised;

c) manually applying to such at least one framed wall a first lifting force structured and arranged to lift such at least one framed wall from the substantially horizontal position to at least one intermediate position, wherein such lift comprises a rotation of such at least one framed wall about at least one bottom plate axis;

d) temporarily supporting such at least one framed wall in such at least one intermediate position by at least one support bar of such at least one wall-lifting system, wherein such at least one support bar is adapted to freely rotate into a substantially vertical support position during lifting of such at least one framed wall to such at least one at least one intermediate position;

e) using at least one force-transfer bar of such at least one wall-lifting system to raise such at least one framed wall from such at least one intermediate position to such at least one substantially vertical position by manually applying to such at least one framed wall a second lifting force.

13. The method according to claim 12 further comprising the step of removing such at least one wall-lifting system from such at least one framed wall on completion of the lift.

14. A wall-lifting system, said system comprising:

a) at least one intermediate support bar structured and arranged to hold at least one framed wall in an intermediate position when such at least one framed wall is lifted from the substantially horizontal position to at least one intermediate position, wherein such lift comprises a rotation of such at least one framed wall about at least one bottom plate axis;

b) at least one force-transfer bar structured and arranged to lift at least one framed wall from such intermediate position to a substantially vertical position;

c) at least one removable engager adapted to removably engage at least one portion of the at least one framed wall;

d) at least one pivot link structured and arranged to pivotally link said at least one force-transfer bar, said at least one support bar, and said at least one removable engager;

e) wherein said at least one removable engager comprises at least one set of fixed jaws structured and arranged to engage opposing sides of at least one framing member of the at least one framed wall;

f) wherein said at least one set of fixed jaws comprises at least one fastening aperture structured and arranged to pass therethrough at least one removable fastener usable to temporarily secure said at least one removable engager to the at least one framing member;

g) wherein said at least one pivot link is structured and arranged to provide at least one independent rotation of each one of said at least one force-transfer bar, said at least one support bar, and said at least one removable engager; and h) wherein said at least one force-transfer member, said at least one support bar, and said at least one removable engager share a common pivot axis.

* * * * *